US009095241B1

(12) United States Patent
Abbuhl

(10) Patent No.: US 9,095,241 B1
(45) Date of Patent: Aug. 4, 2015

(54) OFFSET BRACKET FOR A TOILET SEAT

(76) Inventor: John E. Abbuhl, Bradenton, FL (US)

( * ) Notice: Subject to any disclaimer, the term of this patent is extended or adjusted under 35 U.S.C. 154(b) by 660 days.

(21) Appl. No.: 13/349,686

(22) Filed: Jan. 13, 2012

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12; A47K 13/26
USPC ..... 4/236, 240; 411/84, 389, 388; 248/213.1
See application file for complete search history.

(56) References Cited

U.S. PATENT DOCUMENTS

| | | | | |
|---|---|---|---|---|
| 3,828,395 | A | 8/1974 | Grady | |
| 4,367,567 | A | 1/1983 | Sendoykas | |
| 4,451,940 | A | 6/1984 | Grunz | |
| 4,561,130 | A * | 12/1985 | Bumgardner et al. | 4/253 |
| 5,598,589 | A * | 2/1997 | Frettoli | 4/236 |
| 5,918,321 | A * | 7/1999 | Olle | 4/236 |
| 6,012,886 | A | 1/2000 | Tanamura et al. | |
| 6,101,640 | A | 8/2000 | Brewer et al. | |
| 6,826,803 | B2 | 12/2004 | Twomey | |
| 7,647,652 | B1 | 1/2010 | Baker | |
| 2010/0162476 | A1 * | 7/2010 | Cavagna | 4/236 |

* cited by examiner

*Primary Examiner* — Paul R Durand
*Assistant Examiner* — Janie Christiansen
(74) *Attorney, Agent, or Firm* — Robert C. Montgomery; Montgomery Patent and Design, L.P.

(57) ABSTRACT

An offset bracket device for adjusting the attachment point of a toilet seat to a toilet bowl allows a user to move the pivot point of the toilet seat forwardly away from a toilet water tank in order to prevent the toilet seat from accidentally closing when in an open state. A pair of devices attaches the toilet seat to the toilet; each including bracket having a downwardly extending threaded attachment and an upwardly extending forwardly offset threaded attachment. Each device is installed by orienting the offset threaded attachments with a receiving aperture of the toilet bowl and a receiving aperture of the toilet seat.

16 Claims, 4 Drawing Sheets

OFFSET BRACKET FOR A TOILET SEAT

RELATED APPLICATIONS

Not Applicable

FIELD OF THE INVENTION

The present invention relates generally to toilet seats, and in particular, to an offset bracket for attaching a toilet seat to a toilet seat support surface of a toilet base forward of a water tank.

BACKGROUND OF THE INVENTION

Typically the toilet seat is an ovular or "U"-shaped seating surface that rests upon the upper rim of the toilet bowl. The seat includes a pair of hinge attachments located on a rear end which are fastened to toilet bowl base. The toilet bowl base is provided with fastening apertures located near the rear end of the bowl by the water tank. The fixed location of the fastening apertures does not allow for any flexibility in the positioning of the toilet seat relative to the bowl or the water tank.

A common problem of this design is that the toilet seat or lid will fall from its opened or lifted position. Such an occurrence generally happens when the toilet seat is oversized, padded, provided with a fabric covering, or incorporates a similar modification. These modifications prevent the toilet seat from resting at a properly inclined angle upon the toilet tank to prevent it from falling down. This problem is acerbated when male users have to hold the seat in a lifted position while utilizing the toilet. This presents great problems if the man should have back problems or are otherwise disabled.

SUMMARY OF THE INVENTION

The inventor has therefore recognized the aforementioned inherent problems and lack in the art and observed that there is a need for toilet seats that can be modified in such a manner that they remain in a lifted or open position without being held.

Accordingly, it is an object of the present embodiments of the invention to solve at least one (1) of these problems. The inventor has addressed this need by developing an offset bracket for a toilet seat that allows for the stabilization of a toilet seat and lid in a lifted position. These and other objects are achieved by providing an offset bracket device for connecting a toilet seat to a toilet base forward of a water tank. The bracket device includes bracket plate having an upper surface that is attachable to the toilet seat and a lower surface that is attachable to the toilet base. The bracket plate is a unitary member having a fastener plate portion and a support plate portion. The fastener plate portion includes a first stud fastener protruding perpendicularly from the bracket plate upper surface to insertingly engage a fastener aperture of a toilet seat hinge attachment of the toilet seat. A second stud fastener is provided protruding perpendicularly from the bracket plate lower surface to insertingly engage a fastener aperture of a toilet seat support surface of the toilet base.

In certain embodiments of the invention, the first stud fastener and the second stud fastener each include a threaded upper portion and a threadless cylindrical lower portion. The first stud fastener cylindrical lower portion snugly fits within the fastener aperture of the toilet seat hinge attachment and the second stud fastener cylindrical lower portion snugly fits within the fastener aperture of the toilet seat support surface of the toilet base. The first stud fastener is disposed toward an end of fastener bracket portion and the second stud fastener is disposed toward a center of the fastener bracket portion defining an offset distance between the first stud fastener and the second stud fastener in order to provide an increased resting angle to prevent the toilet seat from falling.

In certain embodiments of the invention, a pair of offset bracket devices is provided for connecting the toilet seat to the toilet base forward of a water tank.

In certain embodiments of the invention, an offset toilet seat device is provided that includes the toilet seat for resting on the toilet seat support surface of the toilet base. The toilet seat includes the pair of toilet seat hinge attachments and a pair of bracket devices for connecting the toilet seat to the toilet base forward of a water tank.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
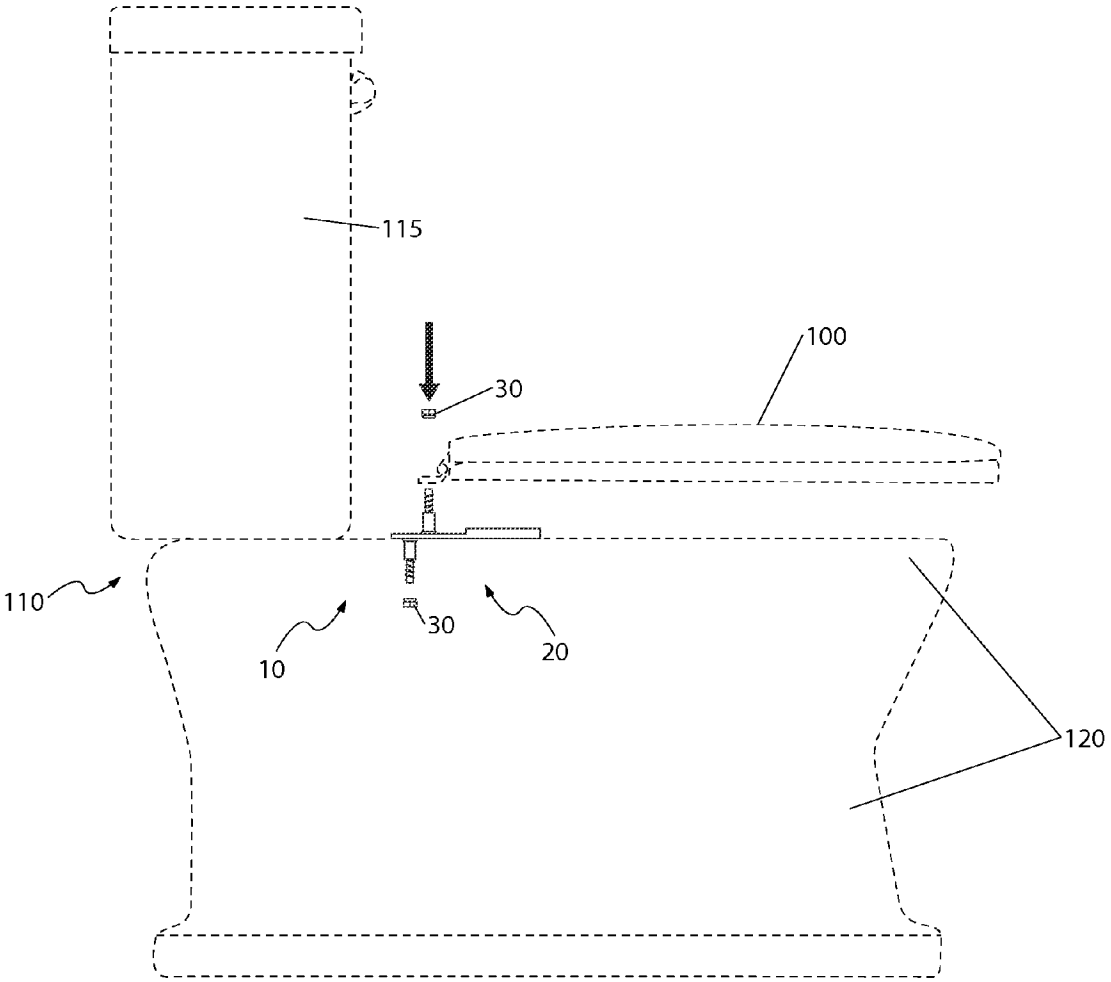
FIG. 1 is a side environmental view of an offset bracket for a toilet seat in accordance with the invention.

10 offset bracket for a toilet seat
20 bracket plate
22 fastener plate
24 support plate
26 first stud fastener
28 second stud fastener
30 nut fastener
35 offset dimension
100 toilet seat
110 toilet
115 water tank
120 toilet bowl

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 5, depicting offset bracket for a toilet seat (herein described as a "device") 10, where like reference numerals represent similar or like parts. In accordance with the invention, the present disclosure describes the device 10 used to anchor a toilet seat 100 such that the toilet seat 100 is forwardly repositioned approximately three-eighths (%) of an inch. In use, a pair of the devices 10 is applied to the toilet seat 100 and a toilet 110.

Figure 2:
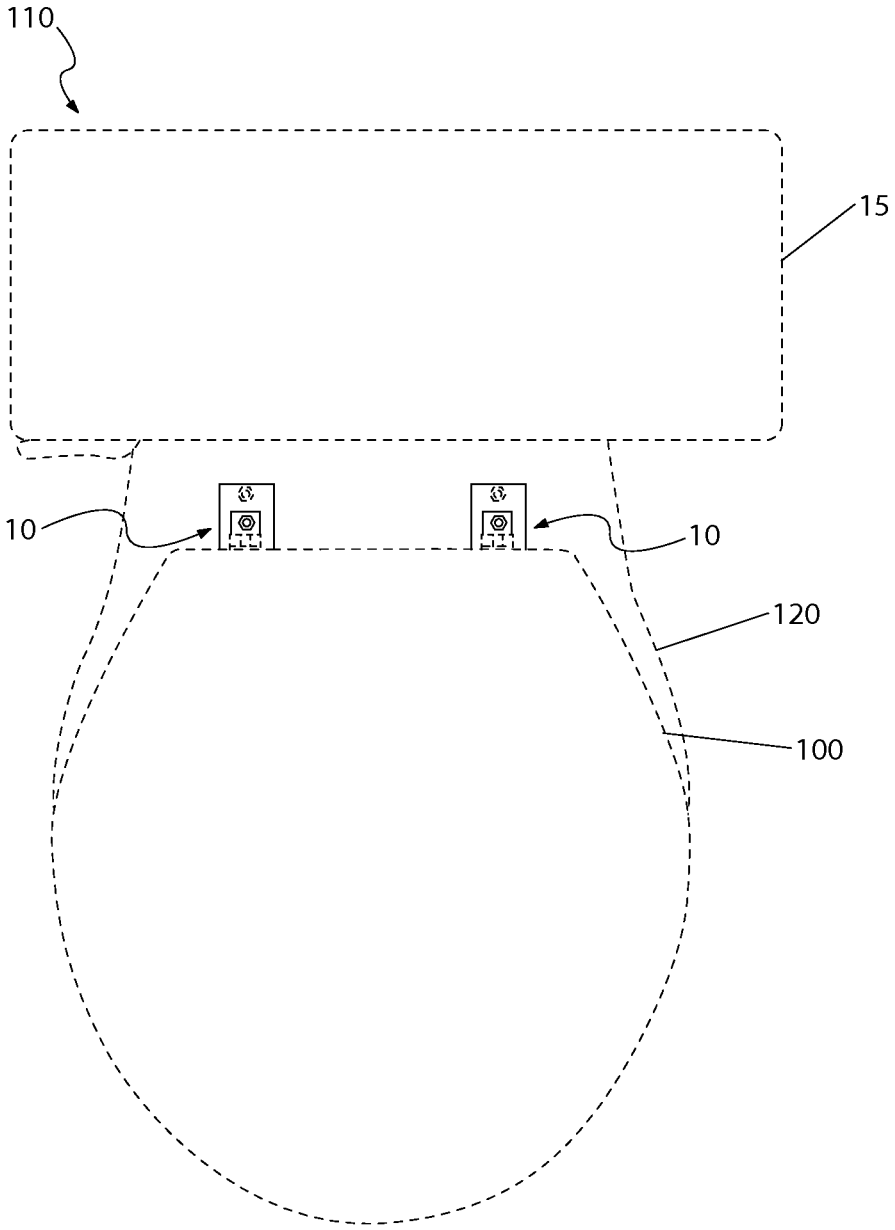
FIG. 2 is a top environmental view of an offset bracket for a toilet seat.

FIGS. 1 and 2 show a side and a top environmental view of the device 10. The toilet 110 is preferably a standard design including a rear-mounted water tank 115 and a toilet bowl 120. The forward repositioning of the toilet seat 100 provides a greater angle for the seat or lid portion of the toilet seat 100 to lean against a water tank 115 in a stable manner when the toilet seat 100 is in a lifted position. The device 10 makes it more likely for the toilet seat 100 to remain in the raised position without needing to be held in position by a user. The device 10 is useful when used in conjunction with padded seats, seats 115 is positioned closer to the toilet bowl 120 than is normal. The device 10 is preferably made of a durable molded nylon material molded in a variety of colors to match an existing décor.

Figure 3:
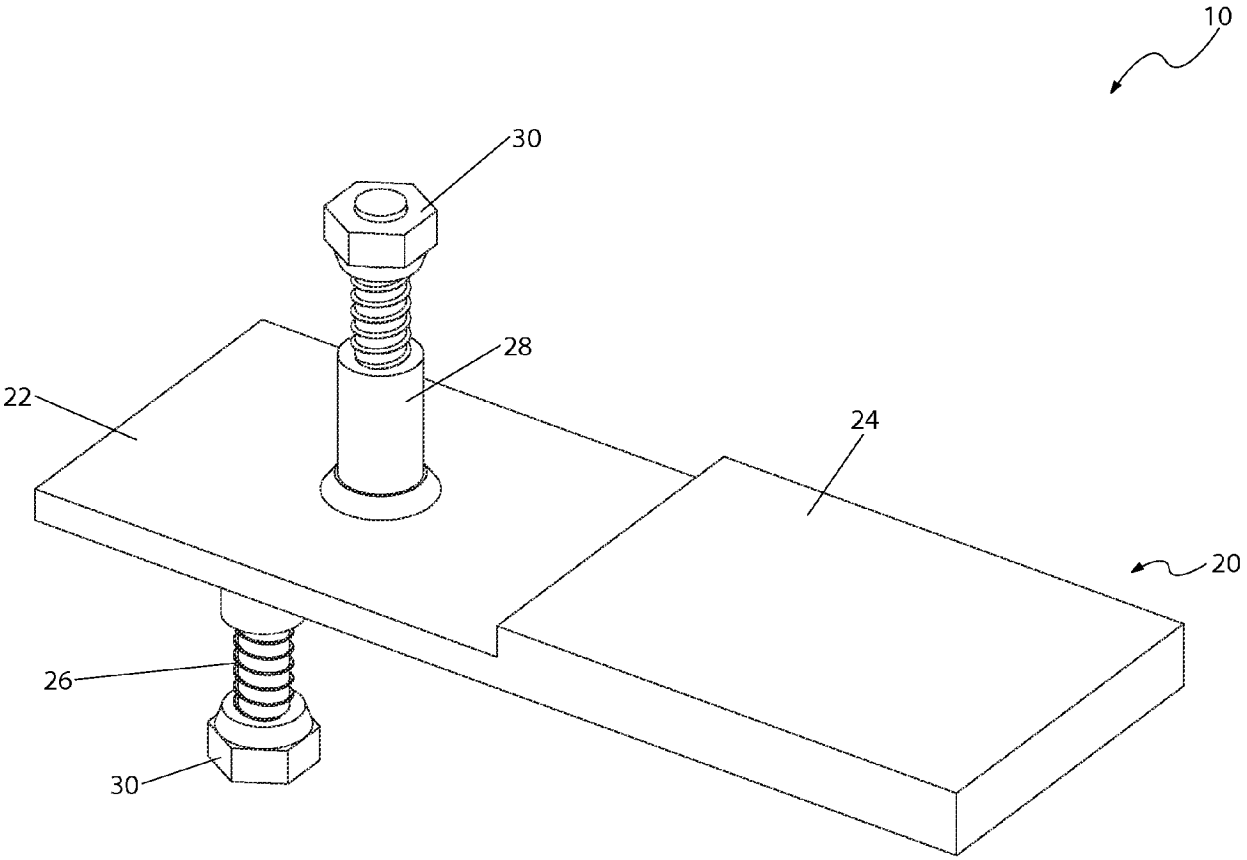
FIG. 3 is a perspective view of the offset bracket for a toilet seat.
Figure 4:
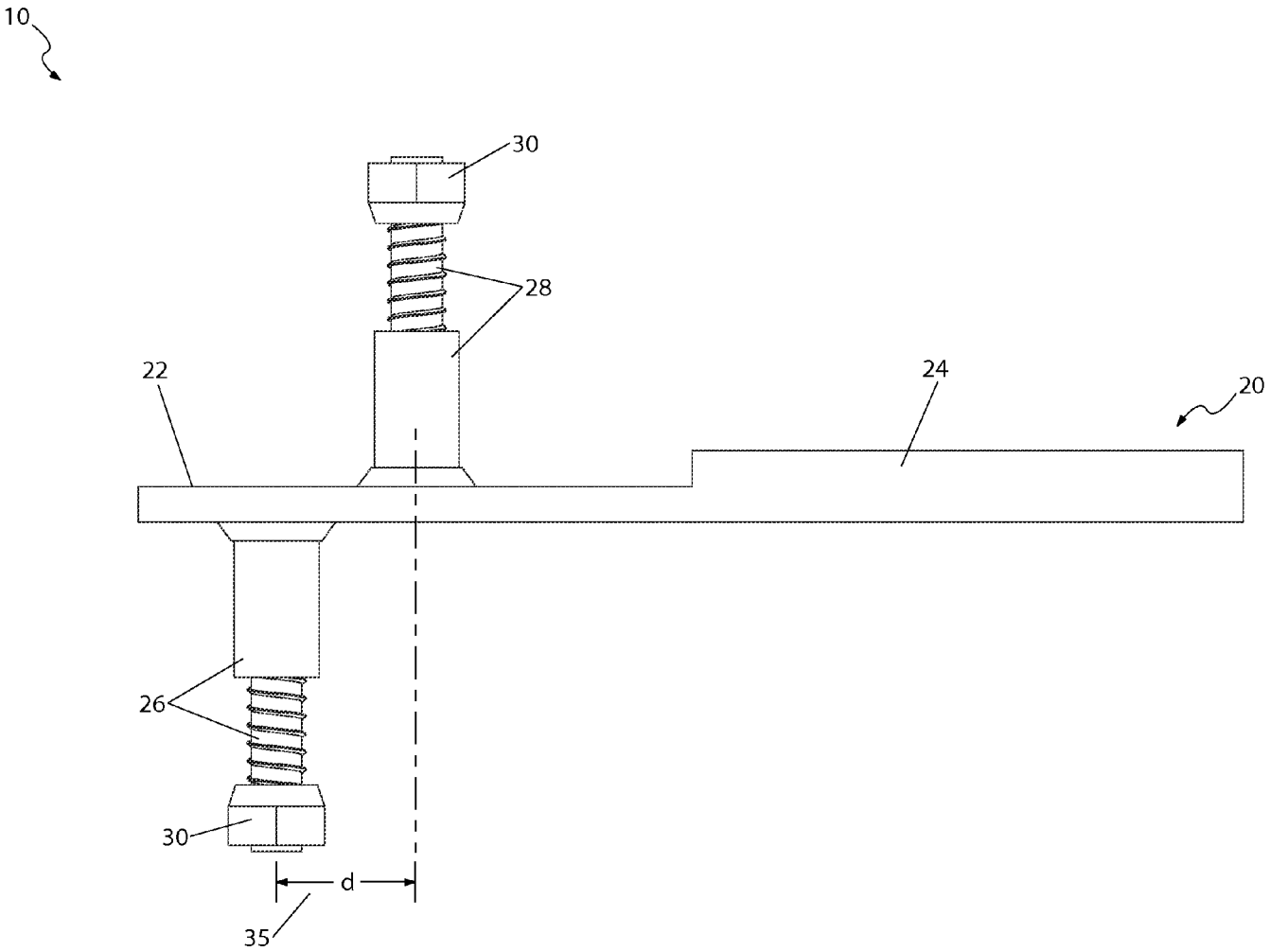
FIG. 4 is a side view of the offset bracket for a toilet seat.

FIGS. 3 and 4 show a perspective and a side view of the device 10. The device 10 is preferably introduced for sale as a pair of identical units 10 allowing the user to secure a single toilet seat 100 to the toilet 110 for use. Each device 10 includes a bracket plate 20. The bracket plate 20 includes a fastener plate 22 and a support plate 24. The bracket plate 20 is a rectangular planar member approximately four (4) inches in length, one-and-one-half (1½) inches in width, and approximately one-quarter (¼) inch thick. The bracket plate 20 is preferably made of nylon or an equivalent resilient material.

The fastener plate 22 constitutes a rearward half of the bracket plate 20 and has a reduced thickness compared with the support plate 24. The fastener plate 22 includes an integrally-molded first stud fastener 26 which protrudes perpendicularly downward and an integrally-molded second stud fastener 28 which protrudes perpendicularly upward. The second stud fastener 28 is forwardly offset from the first stud fastener 26 as indicated by an offset dimension 35. The offset dimension 35 is approximately three-eighths (%) of an inch to reposition the toilet seat 100 forwardly and away from the water tank 115 following installation of the device 10. Each stud fastener 26, 28 is a threaded shaft that is inserted through the fastening apertures in the toilet 110 and toilet seat 100. The device 10 is securely attached to the toilet by attaching a threaded nut fastener 30 to the first stud fastener 26. The toilet seat 100 is securely attached to the device 10 by attaching another threaded fastener 30 to the second stud fastener 28. The support plate 28 constitutes a forward half of the bracket plate 20 which partially protrudes toward a center of the toilet seat 100 to support the bottom surface of a rear portion of the toilet seat 100 normally supported by a rim of the toilet bowl 120.

The first stud fastener 26 and the second stud fastener 28 each include a threaded upper portion and a threadless cylindrical lower portion. The cylindrical lower portion of the first stud fastener 26 is suitably sized to snugly fit within the fastener aperture of the toilet seat hinge attachment of the toilet seat. The cylindrical lower portion of the second stud fastener 28 is suitably sized to snugly fit within the fastener aperture of the toilet seat support surface of the toilet base.

It can be appreciated by one skilled in the art that other styles and configurations of the invention can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it is installed and utilized as indicated in FIGS. 1 and 2.

The method of installing and utilizing the device 10 can be achieved by performing a series of steps. It can be appreciated that the steps described can be performed in alternative order and as such should not be viewed as a limiting factor. Acquiring the device 10 having a desired color to match an existing décor. Removing the existing toilet seat 100 and corresponding attaching hardware from the toilet 110. Installing one (1) device 10 by inserting the first stud fastener 26 downwardly into an aperture of the toilet bowl 120. Securing the device 10 to the toilet bowl 120 by threadingly engaging and tightening the nut fastener 30 to the first stud fastener 26. Installing the second unit of the device 10 into another aperture of the toilet bowl 120 in a similar fashion. Re-installing the toilet seat 100 by inserting the second stud fasteners 28 of the two (2) devices 10 into apertures of the toilet seat 100. Securing the toilet seat 100 to the devices 10 by threadingly engaging and tightening additional nut fasteners 30 to the second stud fasteners 28. Utilizing the toilet seat 100 in a traditional manner. Benefiting from a more stable toilet seat 100 when in the raised position leaning against the water tank 115.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. An offset bracket device for connecting a toilet seat to a toilet base forward of a water tank, said bracket device comprising:

a bracket plate, said bracket plate comprising:

a fastener plate portion, said fastener plate portion comprising a fastener plate thickness; and, a support plate portion rigidly coupled to and longitudinally extending from said fastener plate portion, said support plate portion comprising a support plate thickness, wherein:

said fastener plate portion and said support plate portion form:

a lower surface, said lower surface being configured to be placed in surface contact with said toilet base; and, an upper surface opposite said lower surface, a portion of said upper surface formed by said support plate portion being configured to be placed in surface contact with said toilet seat; and, said support plate thickness is larger than said fastener plate thickness such that said upper surface is nonplanar;

a first stud fastener coupled to said fastener plate portion and being attachable to said toilet base; and, a second stud fastener coupled to said fastener plate portion and being attachable to said toilet seat, wherein:

said first stud fastener is disposed near an end of said fastener plate portion opposite said support plate portion; and, said second stud fastener is offset from said first stud fastener toward said support plate portion.

2. The device of claim 1, wherein said bracket plate is a unitary member.

3. The device of claim 1, wherein:

said first stud fastener protrudes perpendicularly downward from said lower surface for insertingly engaging a fastener aperture of a toilet seat support surface of said toilet base; and, said second stud fastener protrudes perpendicularly upward from said upper surface for insertingly engaging a fastener aperture of a toilet seat hinge attachment of said toilet seat.

4. The device of claim 3, wherein said first stud fastener and said second stud fastener each further comprises a threaded upper portion and a cylindrical lower portion;

wherein said first stud fastener cylindrical lower portion snugly fits within said fastener aperture of said toilet seat hinge attachment of said toilet seat; and, wherein said second stud fastener cylindrical lower portion snugly fits within said fastener aperture of said toilet seat support surface of said toilet base.

5. The device of claim 4, wherein said first stud fastener is secured to said toilet seat hinge attachment of said toilet seat by a threadingly attached nut fastener and said second stud fastener is secured to said toilet seat support surface of said toilet base by another threadingly attached nut fastener.

6. The device of claim 1, wherein said bracket plate lower surface is planar.

7. The device of claim 1, wherein an offset distance between said first stud fastener and said second stud fastener is approximately three-eighths of an inch.

8. The device of claim 1, wherein said bracket plate is approximately four inches long.

9. A pair of offset bracket devices for connecting a toilet seat to a toilet base forward of a water tank, each bracket device of said pair of bracket devices comprising:

a bracket plate, said bracket plate comprising:

a fastener plate portion, said fastener plate portion comprising a fastener plate thickness; and, a support plate portion rigidly coupled to and longitudinally extending from said fastener plate portion, said support plate portion comprising a support plate thickness, wherein:

said fastener plate portion and said support plate portion form:

a lower surface, said lower surface being configured to be placed in surface contact with said toilet base; and, an upper surface opposite said lower surface, a portion of said upper surface formed by said support plate portion being configured to be placed in surface contact with said toilet seat; and, said support plate is larger than said fastener plate thickness such that said upper surface is nonplanar;

a first stud fastener protruding perpendicularly downward from said lower surface formed by said fastener plate portion and being attachable to said toilet base; and, a second stud fastener protruding perpendicularly upward from said upper surface formed by said fastener plate portion and being attachable to said toilet seat wherein:

said first stud fastener is disposed near an end of said fastener plate portion opposite said support plate portion; and, said second stud fastener is offset from said first stud fastener toward said support plate portion.

10. The device of claim 9, wherein each first stud fastener and each second stud fastener further comprises a threaded upper portion and a cylindrical lower portion;

wherein said cylindrical lower portion of said first stud fastener is snugly inserted within a fastener aperture of a toilet seat hinge attachment of said toilet seat;

wherein said cylindrical lower portion of said second stud fastener is snugly inserted within a fastener aperture of a toilet seat support surface of said toilet base;

wherein said threaded upper portion of said first stud fastener is secured to said toilet seat hinge attachment of said toilet seat by a threadingly attached nut fastener; and, wherein said threaded upper portion of said second stud fastener is secured to said toilet seat support surface of said toilet base by another threadingly attached nut fastener.

11. The device of claim 10, wherein said bracket plate lower surface is planar.

12. The device of claim 9, wherein an offset distance between said first stud fastener and said second stud fastener is approximately three-eighths of an inch.

13. The device of claim 9, wherein said bracket plate is approximately four inches long.

14. An offset toilet seat device comprising:

a toilet seat for resting on a toilet seat support surface of a toilet base, said toilet seat comprising a central opening and a pair of toilet seat hinge attachments; and, a pair of bracket devices for connecting said toilet seat to said toilet base forward of a water tank, each bracket device of said pair of bracket devices comprising:

a bracket plate, said bracket plate comprising:

a fastener plate portion, said fastener plate portion comprising a fastener plate thickness; and, a support plate portion rigidly coupled to and longitudinally extending from said fastener plate portion, said support plate portion comprising a support plate thickness, wherein:

said fastener plate portion and said support plate portion form:

a lower surface, said lower surface being in surface contact with said toilet base; and, an upper surface opposite said lower surface, a portion of said upper surface formed by said support plate portion being in surface contact with said toilet seat; and said support plate thickness is larger than said fastener plate thickness such that said upper surface is nonplanar;

a first stud fastener coupled to said fastener plate portion and coupled to said toilet seat hinge attachment; and, a second stud fastener coupled to said fastener plate portion and being attachable to said toilet base, wherein:

said first stud fastener is disposed near an end of said fastener plate portion opposite said support plate portion; and, said second stud fastener is offset from said first stud fastener toward said support plate portion.

15. The device of claim 14, wherein each first stud fastener and each second stud fastener further comprises a threaded upper portion and a cylindrical lower portion;

wherein said cylindrical lower portion of said first stud fastener is disposed within a fastener aperture of said toilet seat support surface of said toilet base;

wherein said cylindrical lower portion of said second stud fastener snugly fits within a fastener aperture of said toilet seat hinge attachment of said toilet seat;

wherein said first stud fastener threaded upper portion is secured to said toilet seat support surface of said toilet base by a threadingly attached nut fastener; and, wherein said second stud fastener threaded upper portion is secured to said toilet seat hinge attachment of said toilet seat by another threadingly attached nut fastener.

16. The device of claim 14, wherein said first stud fastener protrudes perpendicularly downward from said lower surface near an end of fastener plate portion opposite said support plate portion, and wherein said second stud fastener protrudes perpendicularly upward from said upper surface offset from said first stud fastener toward said support plate portion.

* * * * *